US007601068B1

(12) United States Patent
McGee

(10) Patent No.: US 7,601,068 B1
(45) Date of Patent: Oct. 13, 2009

(54) CAR RACING SYSTEM

(76) Inventor: Lewis A. McGee, 90 Crossfire Dr., Covington, GA (US) 30014

( * ) Notice: Subject to any disclaimer, the term of this patent is extended or adjusted under 35 U.S.C. 154(b) by 295 days.

(21) Appl. No.: 11/657,497

(22) Filed: Jan. 24, 2007

(51) Int. Cl.
*A63F 9/14* (2006.01)
*A63H 17/00* (2006.01)

(52) U.S. Cl. ..... 463/58; 463/6; 463/60; 446/435; 446/444

(58) Field of Classification Search ..... 463/61, 463/62, 64, 58–60, 6, 7; 446/489, 443–445, 446/431, 429–430; 273/129 S, 129 R; 238/10 E, 238/10 F, 10 R; 104/53, 60, 77
See application file for complete search history.

(56) References Cited

U.S. PATENT DOCUMENTS 3,565,430 A * 2/1971 McRoskey ..... 463/59
4,033,587 A * 7/1977 Oliver ..... 273/246

* cited by examiner

*Primary Examiner*—Peter DungBa Vo
*Assistant Examiner*—Alex F. R. P. Rada, II

(57) ABSTRACT

A car racing system is disclosed. The car racing system includes an elongated racing surface. User controls interface with the racing surface. A first vehicle traverses the racing surface in one direction and a second vehicle traverses the racing surface in a second direction responsive to input from the user controls.

8 Claims, 4 Drawing Sheets

CAR RACING SYSTEM

FIELD

The present invention relates to car racing systems. More particularly, the present invention relates to a drag racing-style slot car racing system.

BACKGROUND

Toy cars which traverse a simulated racetrack provide enjoyment and competition for persons of all ages. One type of car racing system which has been used for years utilizes "slot cars". A slot car includes an electric motor which electrically engages a pair of power rails embedded in a track. The power rails are connected to a control mechanism which is used to facilitate flow of electrical power through the power rails and energize the electric motor through the wheels. The track typically includes multiple bends or curves and may further include overpasses and underpasses.

SUMMARY

The present invention is generally directed to a car racing system. The car racing system includes an elongated racing surface. User controls interface with the racing surface. A first vehicle traverses the racing surface in one direction and a second vehicle traverses the racing surface in a second direction responsive to input from the user controls.

BRIEF DESCRIPTION OF THE DRAWINGS

The invention will now be described, by way of example, with reference to the accompanying drawings, in which.

DETAILED DESCRIPTION

Figure 1:
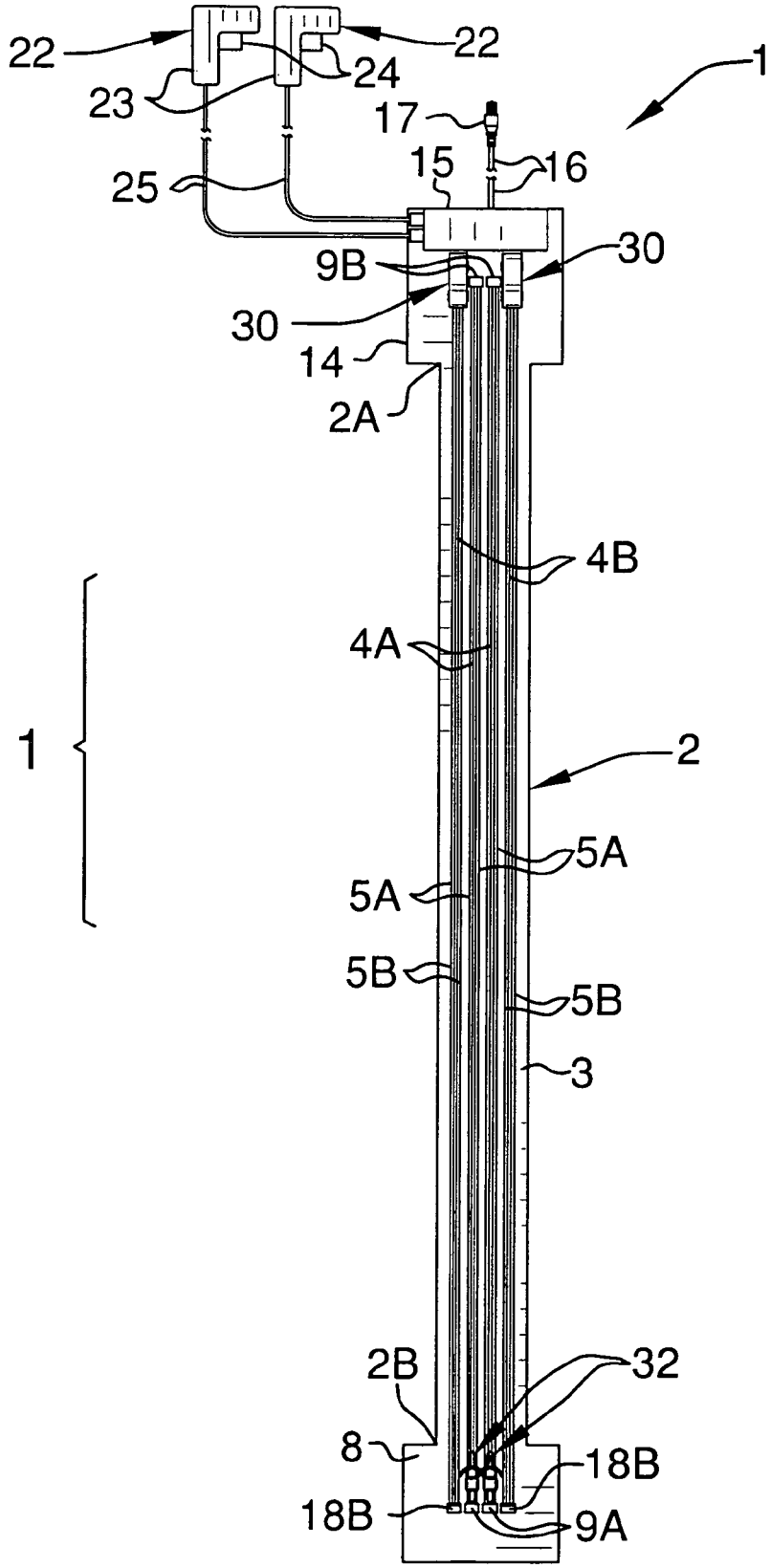
FIG. 1 is a top view of an illustrative embodiment of the car racing system.

Referring to the drawings, an illustrative embodiment of the car racing system is generally indicated by reference numeral 1. The car racing system 1 includes an elongated track 2 having a first panel end 2*a* and a second panel end 2*b*. The track 2 may be plastic or other suitable material and has a racing surface 3. Multiple, adjacent, parallel track slots 4 extend into the racing surface 3 of the track 2. In an illustrative embodiment of the car racing system 1, four track slots 4 extend into the racing surface 3, although this number may vary. Accordingly, the track slots 4 include a pair of inner track slots 4*a* and a pair of outer track slots 4*b*.

Figure 2:
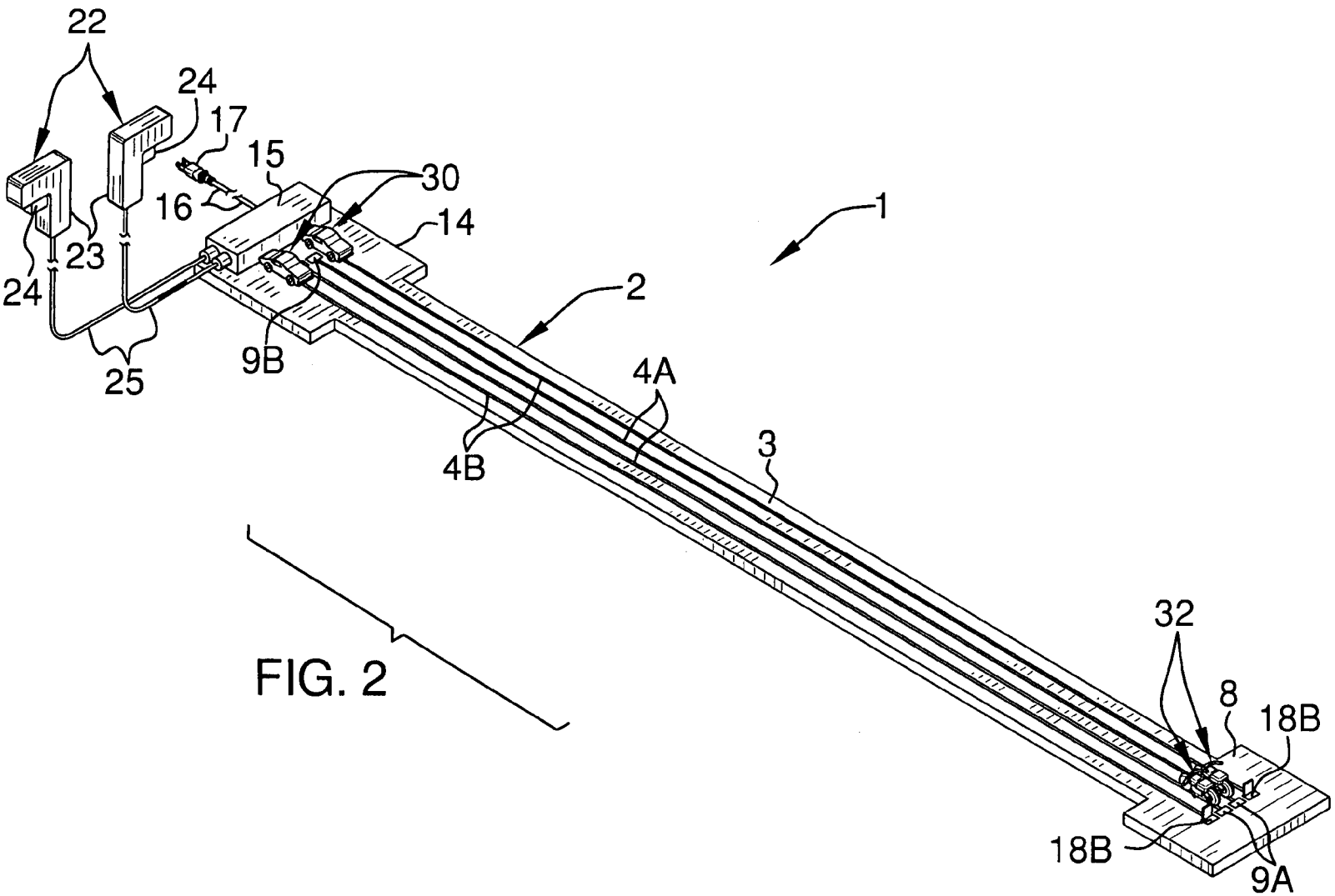
FIG. 2 is a perspective view of an illustrative embodiment of the car racing system.
Figure 3:
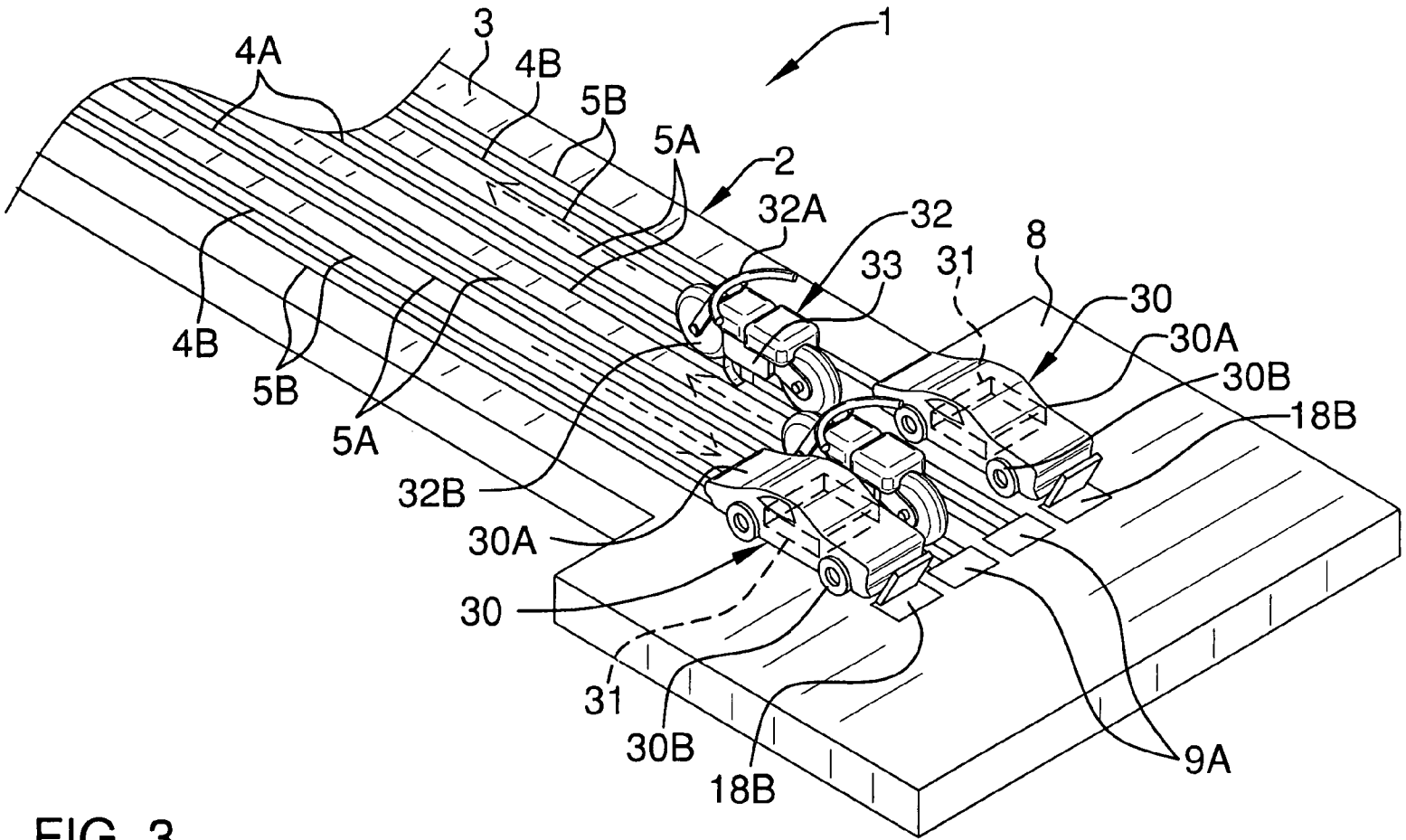
FIG. 3 is a perspective view, partially in section, of a motorcycle start panel end of an illustrative embodiment of the car racing system, illustrating a pair of cars and a pair of motorcycles on separate tracks of the car racing system.

As shown in FIGS. 1-3, a second vehicle start panel 8 extends from the second panel end 2*b* of the track 2. A pair of second vehicle start switches 9*a* is provided on the second vehicle start panel 8, at the ends of respective track slots 4. For example, as shown in FIG. 3, in some embodiments, a pair of second vehicle start switches 9*a* is provided on the second vehicle start panel 8 at the ends of the respective inner track slots 4*a*.

Figure 4:
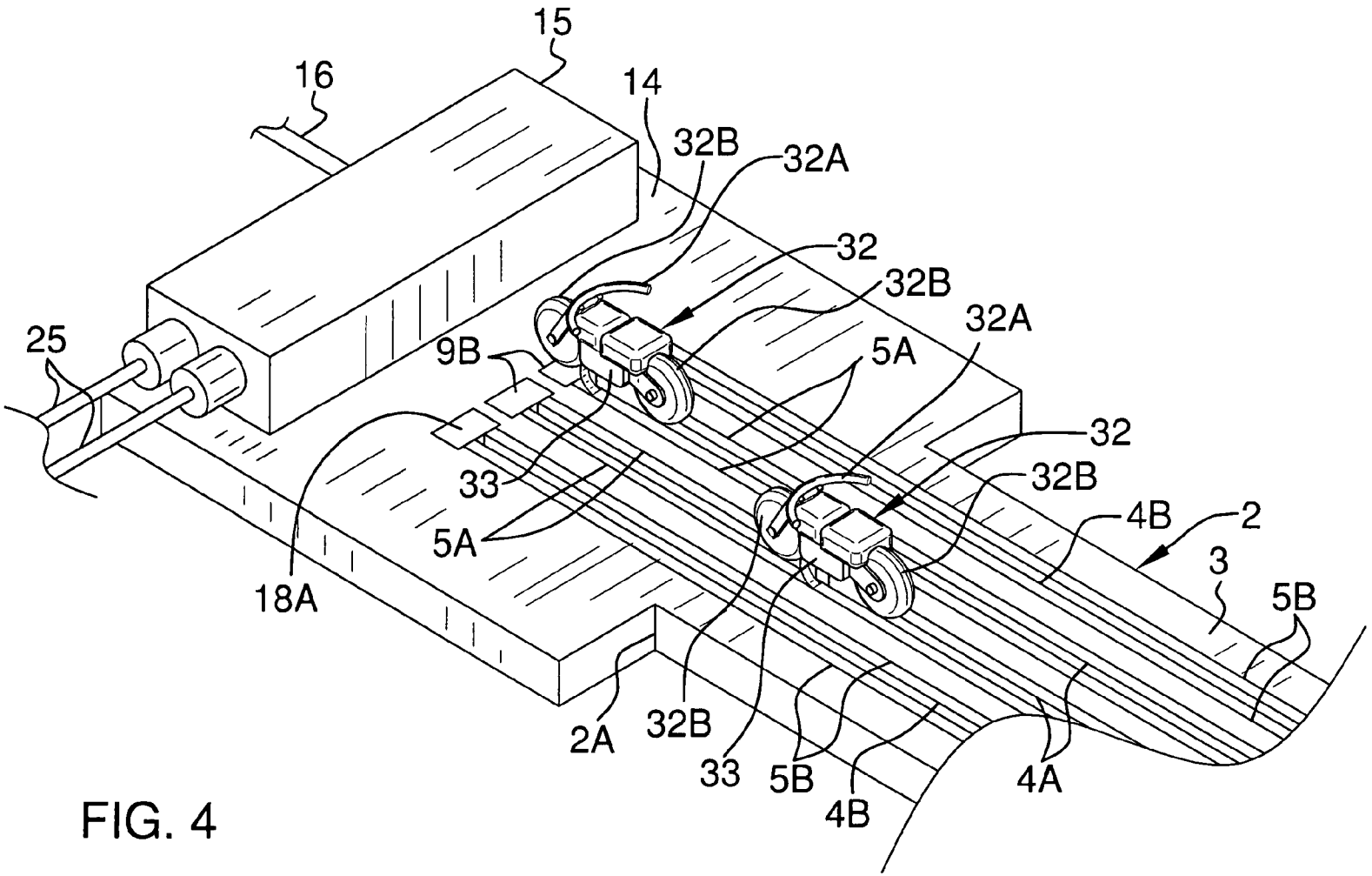
FIG. 4 is a perspective view, partially in section, of a car start panel end of an illustrative embodiment of the car racing system, illustrating a pair of motorcycles on adjacent tracks, respectively, of the car racing system.

As shown in FIGS. 1, 2 and 4, a first vehicle start panel 14 extends from the first panel end 2*a* of the track 2. A pair of second vehicle finish switches 9*b* is provided on the first vehicle start panel 14, typically at the ends of the respective inner track slots 4*a*. First vehicle start switches 18*a* are provided on the first vehicle start panel 14, at the ends of respective track slots 4, such as at the ends of the respective outer track slots 4*b*, for example. As shown in FIGS. 1, 3 and 4, a pair of inner power rails 5*a* is embedded in the racing surface 3 of the track 2, on respective sides of each inner track slot 4*a*. Each pair of inner power rails 5*a* extends between the corresponding second vehicle start switch 9*a* on the second vehicle start panel 8 and second vehicle finish switch 9*b* on the first vehicle start panel 14. A corresponding pair of outer power rails 5*b* is embedded in the racing surface 3, on respective sides of each corresponding outer track slot 4*b*. Each pair of outer power rails 5*b* extends between each first vehicle start switch 18*a* on the first vehicle start panel 14 and the corresponding first vehicle finish switch 18*b* on the second vehicle start panel 8.

An electrical transformer 15 is provided on one of the second vehicle start panel 8 and the first vehicle start panel 14. In the illustrative embodiment of the car racing system shown in the drawings, the transformer 15 is provided on the first vehicle start panel 14. The transformer 15 is electrically connected to each of the second vehicle start switches 9*a* and first vehicle finish switches 18*b* on the second vehicle start panel 8 and to each of the first vehicle start switches 18*a* and second vehicle finish switches 9*b* on the first vehicle start panel 14.

A power cord 16, which terminates in a plug 17, extends from the transformer 15. The plug 17 may be adapted for insertion in a standard household electrical outlet (not shown). A pair of controls 22 includes a pair of control handles 23, each of which may have a generally L-shaped configuration. A spring-loaded trigger 24 is provided on each control handle 23. Each control handle 23 is electrically connected to the transformer 15 through a corresponding pair of control wiring 25. The transformer 15 is electrically connected to each first vehicle start switch 18*a* and each second vehicle finish switch 9*b* on the first vehicle start panel 14.

Through the transformer 15, the trigger 24 of each control 22 is electrically connected to the corresponding first vehicle start switch 18*a*, first vehicle finish switch 18*b* and corresponding second vehicle finish switch 9*b*. Normally, each first vehicle start switch 18*a* is in the open position. Depression of the trigger 24 causes the corresponding first vehicle start switch 18*a* to close, thereby establishing electrical communication between the transformer 15 and corresponding pair of outer power rails 5*b*. Upon release of the trigger 24, the first vehicle start switch 18*a* opens, thereby terminating electrical communication between the transformer 15 and corresponding pair of outer power rails 5*b*.

Each first vehicle finish switch 18*b* is electrically connected to the corresponding adjacent second vehicle start switch 9*a* on the second vehicle start panel 8. Each first vehicle finish switch 18*b* is normally closed and forms a complete circuit with the corresponding first vehicle start switch 18*a*. Upon activation typically in a manner which will be hereinafter described, each first vehicle finish switch 18*b* closes the corresponding adjacent second vehicle start switch 9*a*. This electrically energizes the pair of inner power rails 5*a* which extend between each second vehicle start switch 9*a* and corresponding second vehicle finish switch 9*b*, as long as the trigger 24 on the corresponding control 22 remains depressed. Normally, each second vehicle finish switch 9*b* remains closed unless and until activated typically in a manner which will be hereinafter described.

Each of a pair of first vehicles 30 and a pair of second vehicles 32 is supported by the racing surface 3 of the track 2. In typical application, each of the pair of first vehicles 30 is a car and each of the pair of second vehicles 32 is a motorcycle. Each of the first vehicles 30 and each of the second vehicles 32 may have a conventional "slot car" design. As shown in FIG. 3, each of the pair of first vehicles 30 typically includes a chassis 30*a* which is rendered portable on the racing surface 3 by wheels 30*b*. An electric motor 31 (shown in phantom) is provided in the chassis 30*a*. The motor 31 drivingly engages at least one of the wheels 30*b*. At least one of the wheels 30*b* is electrically conductive and is electrically connected to the motor 31 to power the motor 31, typically conventional slot car design. Each of the pair of second vehicles 32 typically includes a frame 32*a* which is rendered portable on the racing surface 3 by wheels 32*b*. An electric motor 33 (shown in phantom) is provided on the frame 32*a* and drivingly engages at least one of the wheels 32*b*.

A tab (not shown) extends from the frame 32*a* of each second vehicle 32 and is inserted in the corresponding inner track slot 4*a*. In like manner, a tab (not shown) also extends from the chassis 30*a* of each first vehicle 30 and is inserted in the corresponding outer track slot 4*b*. When each first vehicle 30 and each second vehicle 32 is so positioned on the racing surface 3, each wheel 30*b* of the first vehicle 30 contacts a corresponding outer power rail 5*b*. In like manner, when each second vehicle 32 is so positioned on the racing surface 3, each wheel 32*b* of the second vehicle 32 contacts an inner power rail 5*a*. Therefore, electrical power is transferred from the outer power rail 5*b* to the motor 31 of each first vehicle 30 through the wheel or wheels 30*b*. In like manner, electrical power is transferred from the inner rail 5*a* to the motor 33 of each second vehicle 32 through the wheel or wheels 32*b*.

As shown in FIG. 1, in typical application, the first vehicles 30 are positioned at the respective first vehicle start switches 18*a* on the first vehicle start panel 14. The second vehicles 32 are positioned at the respective second vehicle start switches 9*a* on the second vehicle start panel 8. Competing players (not shown) hold the respective controls 22. Each of the controls 22 controls a corresponding one of the first vehicles 30 and a corresponding one of the second vehicles 32. Accordingly, upon depression of the trigger 24 of each control 22, the corresponding first vehicle start switch 18*a* is closed, energizing the outer power rails 5*b*. This facilitates traversal of the first vehicle 30 along the racing surface 3 of the track 2, toward and ultimately against the corresponding first vehicle finish switch 18*b*. Therefore, the first vehicle finish switch 18*b* closes the corresponding adjacent second vehicle start switch 9*a*, energizing the corresponding pair of inner power rails 5*a*. This facilitates traversal of the second vehicle 32 along the racing surface 3, toward and ultimately against the corresponding second vehicle finish switch 9*b*. In response, the second vehicle finish switch 9*b* is opened, terminating flow of electrical power to the inner power rails 5*a*. The player who controls the second vehicle 32 which reaches the corresponding second vehicle finish switch 9*b* first is typically the winner.

While the preferred embodiments of the invention have been described above, it will be recognized and understood that various modifications can be made in the invention and the appended claims are intended to cover all such modifications which may fall within the spirit and scope of the invention.

What is claimed is:

1. A car racing system, comprising:

an elongated racing surface having first and second ends;

a first vehicle start switch provided at said first end of said racing surface;

a first vehicle finish switch provided at said second end of said racing surface;

a second vehicle start switch provided at said second end of said racing surface and connected to said first vehicle finish switch;

a second vehicle finish switch provided at said first end of said racing surface;

a first track slot in said racing surface and extending between said first vehicle start switch and said first vehicle finish switch;

a second track slot in said racing surface and extending between said second vehicle start switch and said second vehicle finish switch;

a first pair of power rails provided on said racing surface on respective sides of said first track slot and connecting said first vehicle start switch to said first vehicle finish switch;

a second pair of power rails provided on said racing surface on respective sides of said second track slot and connecting said second vehicle start switch to said second vehicle finish switch;

a first electrically-powered car provided on said racing surface in electrical contact with said first pair of a first set of power rails;

a second electrically-powered car provided on said racing surface in electrical contact with said second pair of a first set of power rails;

a first electrically-powered motorcycle provided on said racing surface in electrical contact with a first pair of a second set of power rails;

a second electrically-powered motorcycle provided on said racing surface in electrical contact with a second pair of a second set of power rails;

a power source connected to said first vehicle start switch, said second vehicle start switch and said second vehicle finish switch; and at least two controls connected to said power source.

2. The car racing system of claim 1 wherein said power source comprises an electrical transformer and a power cord connected to said electrical transformer.

3. The car racing system of claim 1 wherein said at least two controls each comprises a generally L-shaped control handle and a spring-loaded trigger provided on said control handle.

4. The car racing system of claim 1 further comprising a first vehicle start panel provided at said first end of said racing surface.

5. The car racing system of claim 4 further comprising a second vehicle start panel provided at said second end of said racing surface.

6. The car racing system of claim 5 wherein said transformer is provided on said first vehicle start panel.

7. The car racing system of claim 1 wherein said first vehicle comprises a chassis, at least one electrically-conductive wheel carried by said chassis and an electric motor carried by said chassis and drivingly engaging said at least one wheel and wherein said second vehicle comprises a frame, wheels carried by said frame and a motor carried by said frame and drivingly engaging at least one of said wheels.

8. A car racing system, comprising:

an elongated track having first and second ends and a racing surface between said first and second ends;

a first pair of vehicle start switches provided at said first end of said racing surface;

a first pair of vehicle finish switches provided at said second end of said racing surface between said first pair of vehicle start switches;

a second pair of vehicle start switches provided at said second end of said racing surface and connected to said first pair of vehicle finish switches, respectively;

a second pair of vehicle finish switches provided at said first end of said racing surface;

a first pair of track slots provided in said racing surface and extending between said first pair of vehicle start switches and said first pair of vehicle finish switches, respectively;

a second pair of track slots provided in said racing surface and extending between said second pair of vehicle start switches and said second pair of vehicle finish switches;

a first set of power rails provided on said racing surface on respective sides of said first pair of track slots and connecting said first pair of vehicle start switches to said first pair of vehicle finish switches;

a second set of power rails provided on said racing surface on respective sides of said second pair of track slots and connecting said second pair of vehicle start switches to said second pair of vehicle finish switches;

a first electrically-powered car provided on said racing surface in electrical contact with a first pair of said first set of power rails;

a second electrically-powered car provided on said racing surface in electrical contact with a second pair of said first set of power rails;

a first electrically-powered motorcycle provided on said racing surface in electrical contact with a first pair of said second set of power rails;

a second electrically-powered motorcycle provided on said racing surface in electrical contact with a second pair of said second set of power rails;

an electrical transformer connected to said first pair of vehicle start switches, said second pair of vehicle start switches and said second pair of vehicle finish switches and having a power cord; and at least two controls connected to said electrical transformer.

* * * * *